US006337613B1

(12) United States Patent
Grelier et al.

(10) Patent No.: US 6,337,613 B1
(45) Date of Patent: Jan. 8, 2002

(54) THREE-PHASE HIGH-CURRENT SWITCHGEAR APPARATUS WITH TWINNED POLES PER PHASE, EQUIPPED WITH MAGNETIC COMPENSATION CIRCUITS

(75) Inventors: Claude Grelier, Crolles; Morel Robert, Herbeys, both of (FR)

(73) Assignee: Schneider Electric Industries SA (FR)

( * ) Notice: Subject to any disclaimer, the term of this patent is extended or adjusted under 35 U.S.C. 154(b) by 0 days.

(21) Appl. No.: 09/716,284

(22) Filed: Nov. 21, 2000

(30) Foreign Application Priority Data

Dec. 3, 1999 (FR) ..... 99 15238

(51) Int. Cl.[7] ..... H01H 75/00

(52) U.S. Cl. ..... 335/8; 335/6; 361/93.1; 361/93.6; 361/634; 361/636

(58) Field of Search ..... 335/6, 8, 9, 10; 361/93.1, 93.6, 170, 634, 635, 636

(56) References Cited

U.S. PATENT DOCUMENTS

| | | | | |
|---|---|---|---|---|
| 3,152,287 A | | 10/1964 | Edmunds | |
| 3,962,661 A | | 6/1976 | Boyd et al. | 336/84 |
| 4,110,806 A | | 8/1978 | Murano et al. | 361/4 |
| 4,215,328 A | | 7/1980 | Chabot et al. | 335/6 |
| 4,884,047 A | * | 11/1989 | Baginski et al. | 335/10 |
| 4,958,135 A | * | 9/1990 | Baginski et al. | 335/8 |

FOREIGN PATENT DOCUMENTS

| | | |
|---|---|---|
| EP | 0 320 412 A1 | 6/1989 |
| EP | 0 859 395 A2 | 8/1998 |
| EP | 0 926 793 A1 | 6/1999 |
| EP | 0 955 656 A2 | 11/1999 |
| EP | 0 957 500 A1 | 11/1999 |
| FR | 2 725 320 | 4/1996 |
| GB | 773193 | 4/1957 |
| GB | 1264299 | 2/1972 |

* cited by examiner

*Primary Examiner*—Ramon M Barrera
(74) *Attorney, Agent, or Firm*—Parkhurst & Wendel, L.L.P.

(57) ABSTRACT

In a three-phase switchgear apparatus having two adjacent poles per phase, the inner pole of each side phase is equipped with a magnetic compensation circuit designed to optimize the current distribution between the two poles and of each side phase in balanced three-phase operation. This arrangement enables the currents flowing in the two poles of either of the side phases to be balanced, by specifically reducing the current intensity and temperature in the inner pole of the side phases.

9 Claims, 6 Drawing Sheets

THREE-PHASE HIGH-CURRENT SWITCHGEAR APPARATUS WITH TWINNED POLES PER PHASE, EQUIPPED WITH MAGNETIC COMPENSATION CIRCUITS

BACKGROUND OF THE INVENTION

The invention relates to three-phase, high-current switchgear apparatuses, with or without neutral, comprising pole compartments connected in parallel.

The document EP 0,320,412 describes a three-phase, high-current switchgear apparatus, in this case a circuit breaker, comprising two adjacent pole compartments per pole, and two adjacent pole compartments for the neutral. Each pole compartment comprises two separable contacts each connected to a contact strip. The pole compartments of the same phase are twinned by electrically connecting the contact strips two by two by means of a connecting strip. Each pair of twinned poles thus constitutes a current loop formed by the two connecting strips and the conductors of the two pole compartments. Each phase is connected to a busbar at the level of its connecting strips.

It so happens that when the circuit breaker is closed, in balanced three-phase AC operation, the mutual electromagnetic interaction between the phase currents gives rise to a non-homogenous distribution of the currents in the bars and in the conducting parts of the circuit breaker. The electromagnetic field generated by each of the conductors influences the current distribution in the other conductors. Globally, a non-homogeneous temperature rise of certain conducting parts is then observed, known by the name of proximity effect.

On account of the fact that the electromotive forces induced by flow of the current in the different branches of circuit increase with the circuit breaker rating, the heterogeneity is all the greater the higher the circuit breaker rating. For a rated phase current of 6300 A for example, a distribution of the rms value of the current of about ⅓, ⅔ can be observed between the two compartments of one and the same phase, so that the current intensities or temperatures reached at certain points may exceed the limits fixed by the standards.

To stabilize the current distribution between the two branches corresponding to two twinned poles of the same phase of a low-voltage power circuit breaker, it has already been proposed in the document FR 2,063,078 to make the conductors of the two branches cross, so as to superpose the two portions of conductors in which currents are flowing in opposite directions, and to incorporate a magnetic circuit entwining the two superposed conductors. From the indications given by this document, it is apparent that such a device compensates the differences of current intensity between the two branches of one and the same phase generated by the electrical resistance differences, for example at the level of the contact resistances of the contacts of each of the branches. Knowing that in practice the differences between contact resistances of two poles are about 5%, this device proves effective for small current intensity variations between the two compartments of the same phase. However, the device proves difficult to implement when the unbalance between phases becomes great or when the rating of the apparatus increases. In particular, crossing of the conductors in a single magnetic circuit, although it does not cause any problem for medium intensity currents of about 630 A, can no longer be applied for very high current apparatuses, in excess of 4000 A in particular, for obvious reasons of dimensions. And yet it is precisely on very high current apparatuses that the effect of the mutual induced electromotive forces between branches of the electrical circuit internal to the apparatus becomes critical. The teachings of the document FR 2,063,078 therefore do not enable a solution to be provided to the specific problem arising from the proximity effect between phases described previously.

Another method for stabilizing the current distribution between the two branches corresponding to two twinned poles of any one phase of a low-voltage power circuit breaker would consist in arranging the two poles of each phase in non-contiguous manner, for example so that the two poles of each phase are separated from one another by one of the poles of each of the other two phases. If we number the six pole compartments from one side of the circuit breaker to the other from 1 to 6, we would thus have: poles 1 and 4 for a first phase, poles 2 and 5 for a second phase, and poles 3 and 6 for the third phase. Such an arrangement does however give rise to large dimensions at the level of the busbars of the different phases and of the bridge connections between poles of the same phase. Moreover, it prevents any interaction device between pole compartments of the same phase: it makes it impossible in particular to provide a communicating orifice between the two pole compartments of the same phase, as described for example in the document FR 2,778,788, an orifice which enables an adequate distribution of the breaking energy to be ensured in case of opening of the apparatus on a fault.

OBJECT OF THE INVENTION

The object of the invention is therefore to improve, or even optimize, distribution of the electrical current and temperatures between the twinned poles composing the phases of a three-phase switchgear apparatus with contiguous twinned poles, limiting the additional cost arising from the arrangements adopted as well as the increase of the dimensions of the apparatus.

According to the invention, this objective is achieved by means of a three-phase electrical switchgear apparatus comprising a case made of insulating material comprising at least six pole compartments arranged side by side, each phase comprising:

- two adjacent poles, each pole comprising
  - one of said pole compartments and
  - a pair of separable contact means formed by a first and a second contact means;
- a first bridge connection electrically connecting the first contact means of the two adjacent poles of said phase;
- a second bridge connection electrically connecting the second contact means of the two adjacent poles of said phase;

one of the three phases constituting a center phase bounded on each side by the other two phases which each form a side phase, one of the two poles of each side phase forming an inner pole whose pole compartment is adjacent to one of the pole compartments of the center phase, and wherein:

- each of said inner pole compartments of the two side phases comprises a magnetic compensation circuit arranged between one of the two bridge connections of said phase and the pair of contact means of said inner pole compartment,
- the other two pole compartments of the two side phases are not provided with magnetic compensation circuits.

Indeed, in balanced three-phase operation, the electromagnetic interaction between the phases located in the same plane has the effect of increasing the intensity of the current flowing in the inner poles of the side phases to the detriment of the current flowing in the outer poles of these same phases. It is therefore also the inner poles of the side phases which are the most affected by temperature increases by Joule effect. According to the invention, by arranging the magnetic circuits judiciously on the inner branches of the side phases, an impedance is introduced into the circuit which makes the current decrease in targeted manner in the pole compartment where the magnetic circuit is situated. The desired result is thus achieved with minimum additional cost.

The fact that the bridge connections form part of the apparatus enables the influence of the parts of the circuit situated outside the apparatus, in particular the influence of the supply busbar, to be eliminated. In other words, the current loops of each phase formed by the conductors of the two pole compartments and the source-side and load-side bridge connections are defined at the time the apparatus is designed and do not depend on the on- site assembly. It is therefore possible to calibrate the magnetic circuit judiciously so as to obtain the required compensation for given power supply conditions. The compensation obtained is then independent of the composition of arrangement of the source-side and load-side circuits and in particular of the arrangement of the busbars.

Advantageously, for each inner pole compartment, the magnetic compensation circuit forms part of a current transformer comprising in addition a secondary winding for supply of an electronic circuit of the apparatus. The switchgear apparatuses are often provided with at least one magnetic supply circuit arranged on each of the pole circuits. One of the existing magnetic supply circuits is then used for compensation, and the magnetic supply circuit of the adjacent pole compartment of the same phase is simply not fitted. The effect sought for is then achieved with a reduced cost with respect to the unit cost of a pole.

Advantageously, for each inner pole, the magnetic circuit comprises:

- a main part surrounding a conducting part of one of the contact means, a portion of this main part constituting a core for the secondary winding; and
- a magnetic shunt branch-connected on said portion constituting the core of the secondary winding, the magnetic shunt comprising a total or partial air-gap.

The air-gap is said to be partial when it is not zero over a part of the cross-section of the shunt and is zero over the remaining part of the cross-section. This type of circuit, described for example in the document EP 0,704,867, classically provides the advantage of shunting the core providing the power supply to the secondary circuit when the primary current exceeds a certain threshold value. This type of magnetic circuit here in addition enables the two functions of power supply and compensation performed by the magnetic circuit to be separated. The core designed for the function of supplying power to the electronic circuit and the shunt performing the function of compensation and of peak-clipping above the threshold value can in fact be dimensioned relatively independently from one another.

According to a preferred embodiment, for each inner pole compartment, the current transformer is situated inside said pole compartment. The location usually reserved for the supply current transformer is then used.

In other words it is possible with such an arrangement to adopt a common architecture for an apparatus with one pole per phase and for an apparatus with two twinned poles per phase.

According to another embodiment, for each inner pole compartment, the current transformer is situated outside said pole compartment. This arrangement provides more space for housing the magnetic circuit. It moreover prevents the temperature rise of the magnetic circuit caused by iron losses from causing a temperature increase of the corresponding inner pole compartment.

Preferably, the magnetic compensation circuit is dimensioned in such a way that, when the apparatus is supplied in balanced three-phase operating conditions at its rated voltage and has its rated current flowing through it at its rated frequency, each magnetic compensation circuit generates an impedance in the inner pole compartment such that the current flowing in the inner pole of each side phase is lower than or equal to the current flowing in the other pole of the same phase. The strict equality between the rms values of the currents flowing in the two branches of a side phase enables a balance to be obtained between the energies dissipated in the two pole compartments of any one phase. But it is known that in numerous configurations, heat removal is potentially greater for the outer poles of the side phases. In this case, an over-compensation enables most of the current to be switched to the compartment which is easiest to cool.

Advantageously, the bridge connections are fixedly secured to the case. The switchgear apparatus is then delivered to site with its bridge connections fitted. The bridge connections are preferably fixed outside the pole compartments.

According to a particular embodiment, the apparatus is a plug-in unit and comprises:

- a frame in which the case is able to slide between a plugged-in position and a plugged-out position,
- connection strips fixedly secured to the frame, each contact means having one of the connection strips corresponding thereto,
- draw-in finger contacts, each of said contact means having one or more draw-in finger contacts corresponding thereto and providing a disconnectable electrical connection between said contact means and the corresponding connection strip, said bridge connections being arranged in such a way that, for each phase, the first bridge connection electrically connects the first contact means via the draw-in finger contact or contacts corresponding to said connected first contact means and that, for each phase, the second bridge connection electrically connects the second contact means via the draw-in finger contact or contacts corresponding to said connected second contact means.

This arrangement enables the currents flowing in the connecting circuits between the connection strips and the contact means, including the draw-in finger contacts, to be taken into account in compensation.

BRIEF DESCRIPTION OF THE DRAWINGS

Other advantages and features of the invention will become more clearly apparent from the following description of different embodiments of the invention given as non-restrictive examples only and represented in the accompanying drawings in which.

DETAILED DESCRIPTION OF THE PREFERRED EMBODIMENTS

Figure 1:
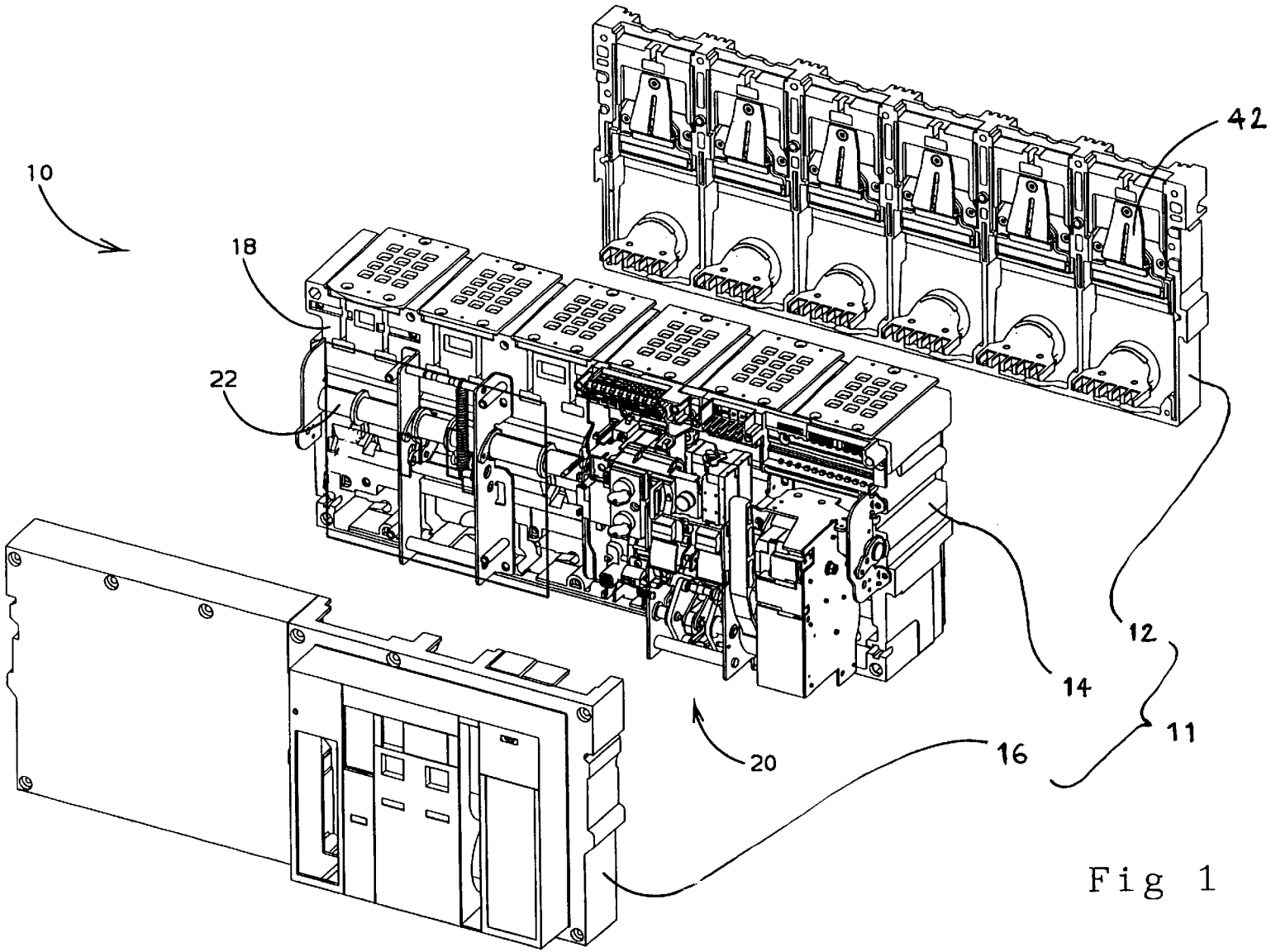
FIG. 1 represents an exploded perspective view of an electrical switchgear apparatus according to a first embodiment of the invention.

With reference to FIGS. 1 to 5, a six-pole three-phase circuit breaker 10 comprises an insulating case 11 formed by assembly of a rear panel 12, an intermediate block 14 with open ends and a front panel 16, which bound a rear compartment and a front compartment, on each side of a front partition 18 of the intermediate block 14. The front compartment houses an operating mechanism 20 of the circuit breaker 10 which acts on a switching shaft 22 common to all the poles of the circuit breaker. This mechanism 20 is fitted onto the front partition 18 of the intermediate block 14.

Figure 2:
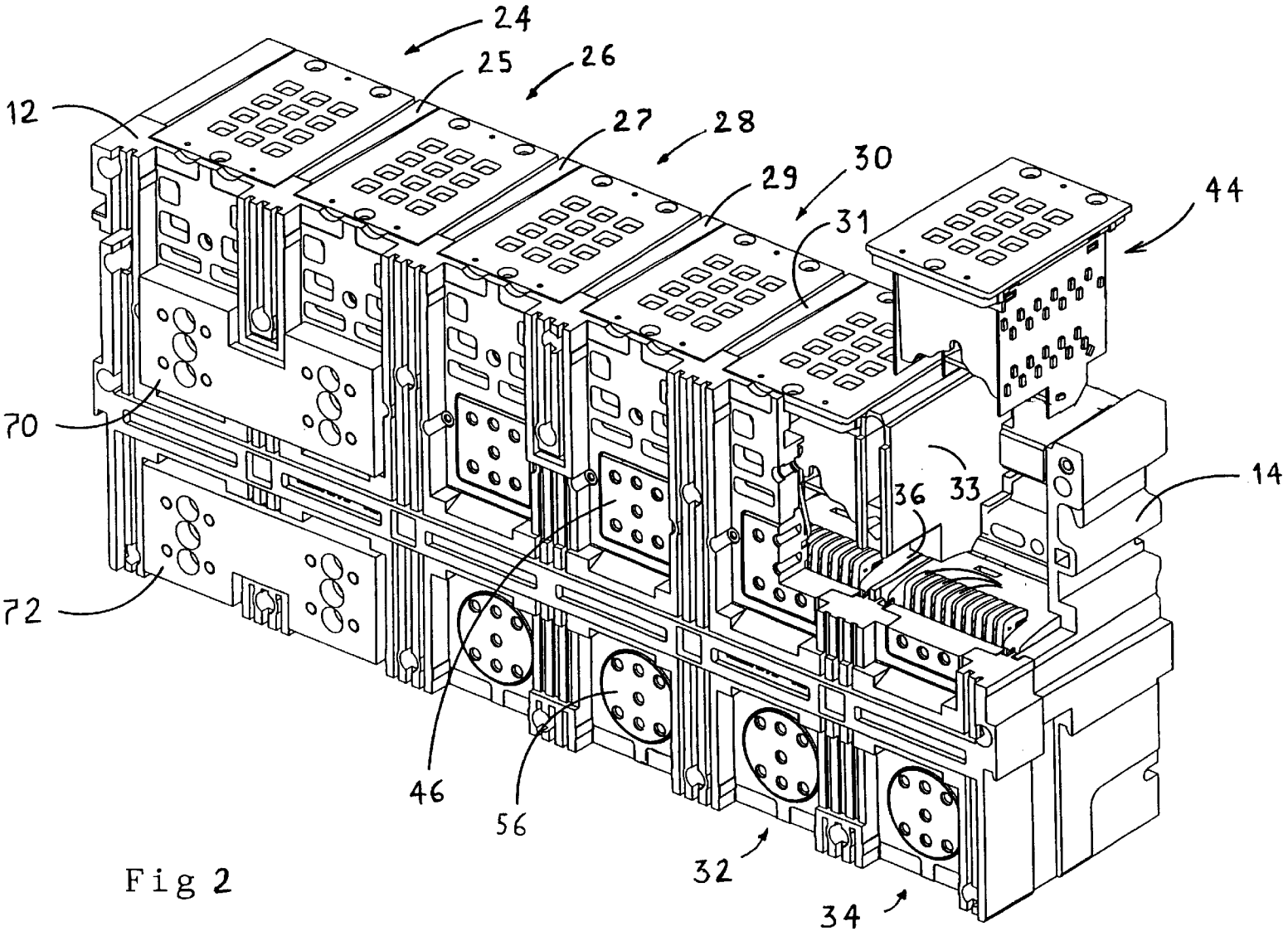
FIG. 2 represents a perspective view of the electrical switchgear apparatus according to the first embodiment of the invention, showing in particular the rear part of the apparatus.

As shown in FIG. 2, the rear compartment is itself subdivided into six individual pole compartments 24, 26, 28, 30, 32, 34 by intermediate partitions 25, 27, 29, 31, 33. The pole compartments are aligned side by side and thus form three adjacent pairs, each pair corresponding to a phase of the circuit breaker. The partitions 25, 29 and 33 which each separate the two pole compartments of the same phase are provided with a communicating orifice 36, described in detail in the document FR 2,778,788. This orifice 36 is designed to improve the distribution of the breaking energy when separation of the contacts takes place. The partitions 27 and 31 are for their part tightly sealed. In the following, the phase comprising the pole compartments 28, 30 will be called the center phase, and the other two phases, which are located on each side of the center phase, will be called the side phases. One of the side phases comprises the pole compartment 26 called the inner compartment, adjacent to the pole compartment 28 of the center phase, and the pole compartment 24 called the outer compartment, whereas the other side phase comprises the pole compartment 32 called the inner compartment, adjacent to the pole compartment 30 of the center phase, and the pole compartment 34 called the outer compartment.

Figure 3:
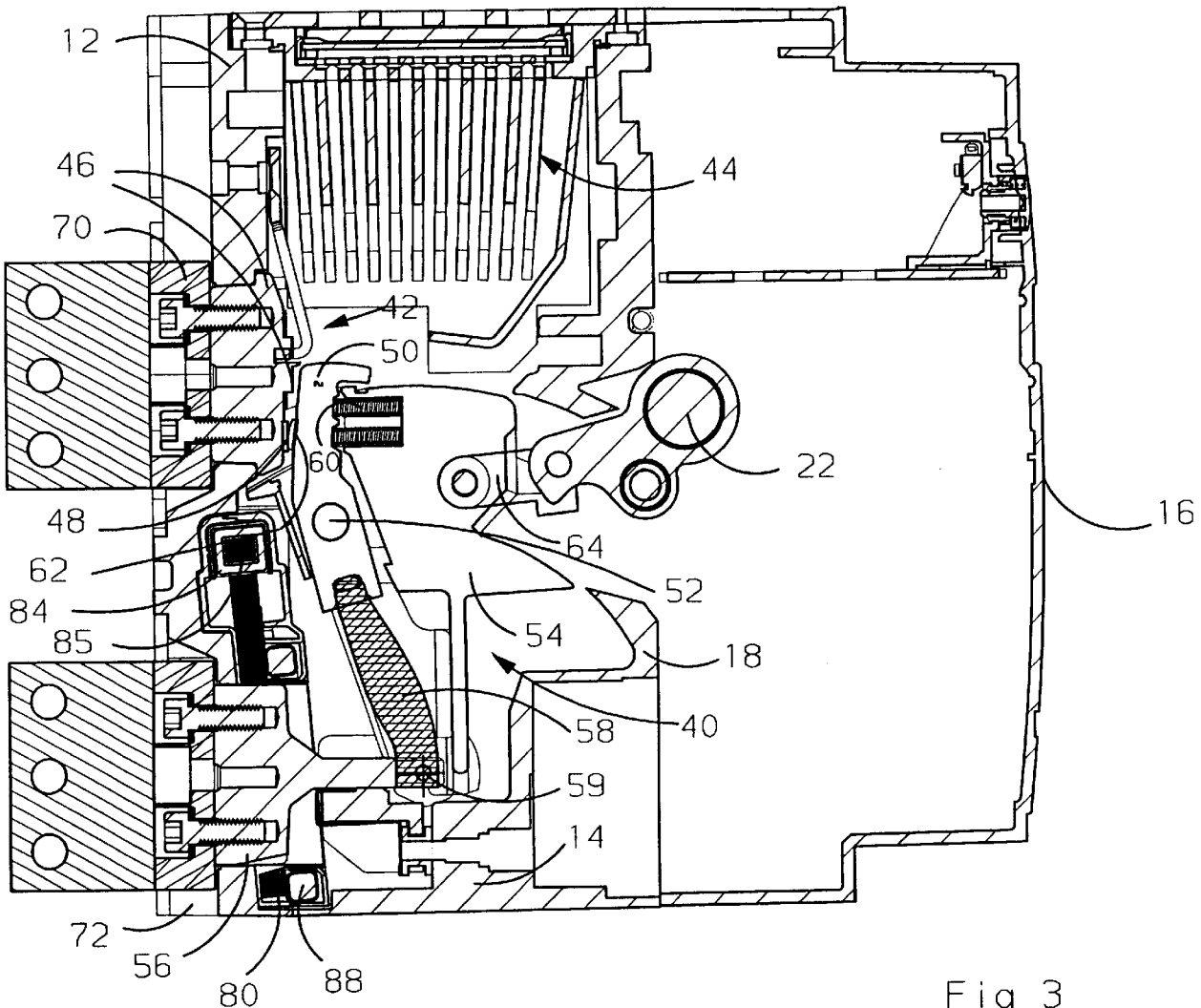
FIG. 3 represents a cross-sectional view of an inner pole compartment of a side phase of the apparatus of FIG. 1.

Each pole comprises a movable contact means 40, a stationary contact means 42, and an arc extinguishing chamber 44 equipped with separators, as well as the corresponding pole compartment which houses these elements at least partially. The stationary contact means 42 comprises a contact strip 46 made of conducting material, in this instance copper, passing through the rear panel 12 of the case, and a contact pad 48. The movable contact means 40 comprises a plurality of contact fingers 50 arranged side by side and pivotally mounted on a first transverse spindle 52 of a support cage 54. The heel of each finger 50 is connected to a second contact strip 56 passing through the rear panel 12 by means of a braid 58 made of conducting material. The contact strips 46, 56 are designed to be connected to the source-side and load-side electrical power system, for example via a busbar. The end of the cage 54 situated close to the second contact strip 56 is equipped with a spindle housed in a bearing fixedly secured to the insulating case so as to allow pivoting of the cage 54 between an open position and a closed position of the pole around a geometric axis 59 materialized in FIG. 3. A contact pressure spring device 60 is arranged in a notch of the cage 54 and urges the contact fingers 50 pivotally around the first spindle 52 in the direction of the contact 48. Each contact finger 50 comprises a contact pad 62 which, in the position represented in FIG. 3, is in contact with the single pad 48 arranged on the stationary contact means 42. The cage 54 is coupled to the switching shaft 22 by means of a transmission rod 64 in such a way that rotation of the shaft 22 causes pivoting of the cage 54 around the axis 59.

In FIG. 2 a bridge connection 70 is represented made of conducting material which electrically connects the stationary contact means 42 of the two adjacent poles 24, 26 forming one of the side phases. Likewise, a bridge connection 72 electrically connects the movable contact means 40 of the two adjacent poles 24, 26. The other two phases are also provided with bridge connections identical to the bridge connections 70, 72, but these bridge connections have not been represented in FIG. 2 in order to enable the rear part of the contact strips 46, 56 to be visualized. For each phase, the bridge connections 70, 72 enable twinning of the adjacent poles connected in parallel to be achieved and form a current loop with the conductors situated in the twinned pole compartments.

Figure 5:
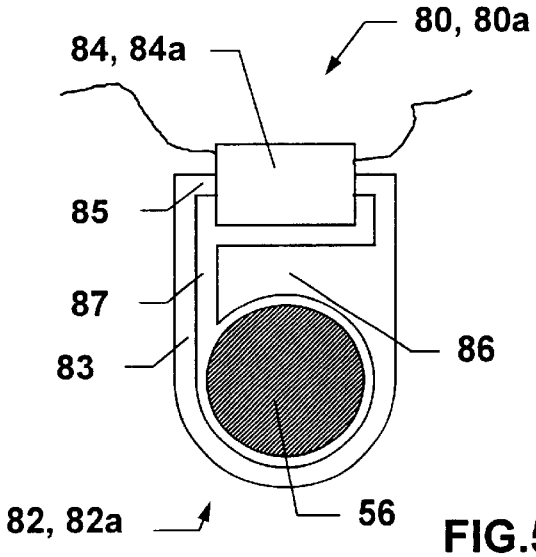
FIG. 5 schematically represents a top view of a detail of a magnetic circuit used in the first embodiment of the invention.

As indicated in FIGS. 3 and 5, each of the inner poles 26, 32 of the side phases is provided with a current transformer 80 designed to supply an electronic circuit of the circuit breaker. The supply current transformer 80 comprises, in a manner known in itself, a magnetic circuit 82 constituted by a stack of transformer plates forming a magnetic circuit around the conductor forming the contact strip 56 of the movable contact means 40, and a coil 84 forming a secondary winding supplying power to the electronic circuit of the circuit breaker. The compensating transformer 80 is of the type with a magnetic shunt with a partial or total air-gap, as described in the document EP 0,704,867. The magnetic circuit comprises a main circuit 83 surrounding the primary conductor formed by the contact strip 56. A portion of the main magnetic circuit 83 constitutes a magnetic core 85 of the secondary winding 84. The magnetic circuit 82 comprises in addition a magnetic shunt 86 branch-connected on the core 85. This magnetic shunt comprises an air-gap 87 situated between one end of the shunt 86 and a part of the main magnetic circuit, which connects a zone close to the primary conductor and the core 85 of the secondary winding 84. The cross-section of the magnetic shunt 86 close to the air-gap is greater than the cross-section of the magnetic circuit at the location of the core 85 of the secondary winding 84. The main magnetic circuit 83, core 85 and shunt 86 constitute a single part formed by stacked plates or by other magnetic materials.

Figure 4:
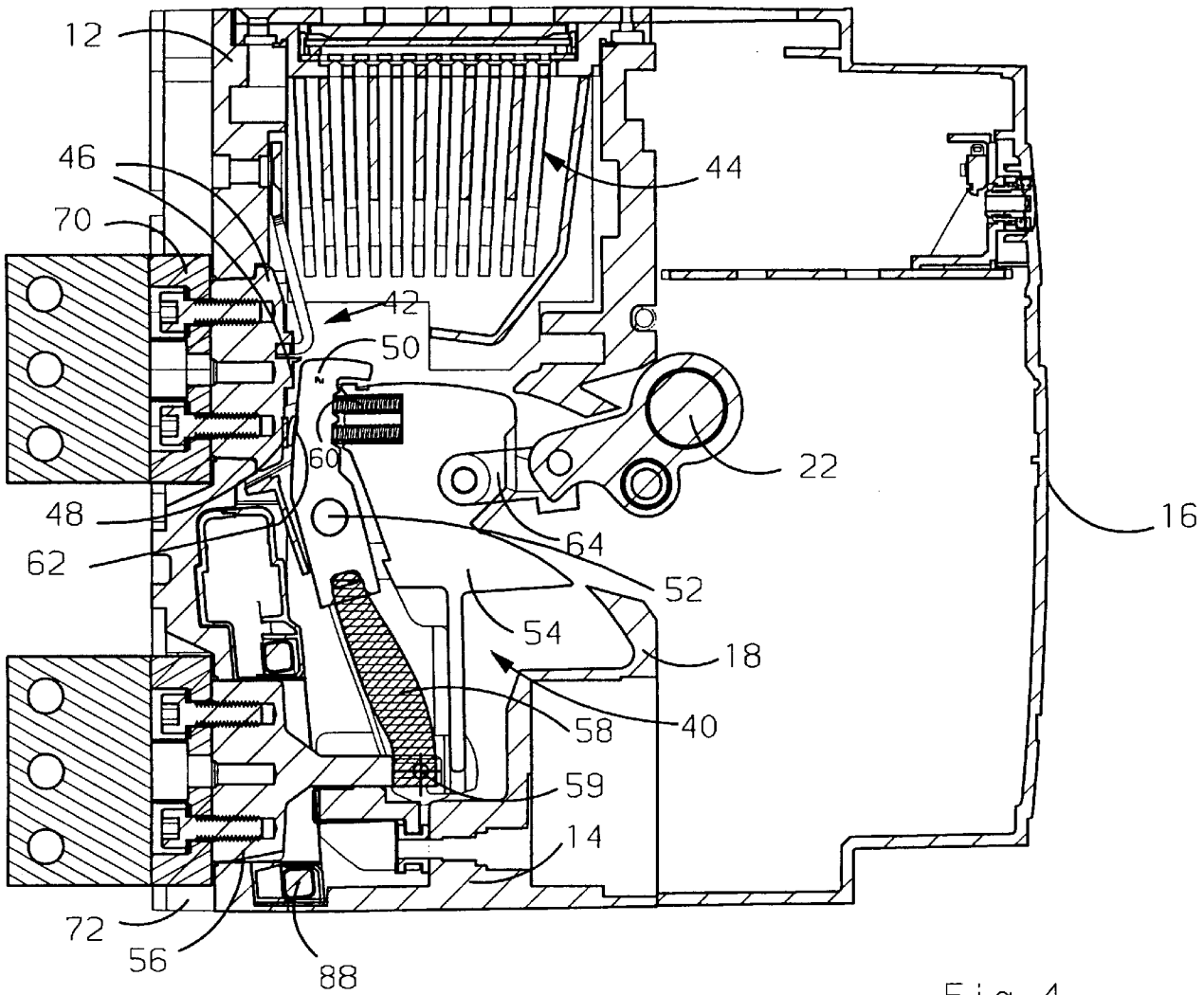
FIG. 4 represents a cross-sectional view of an outer pole compartment of a side phase of the apparatus of FIG. 1.

The two outer poles of the side phases are, for their part, not equipped with supply current transformers, as shown by FIG. 4.

Both of the poles 28, 30 of the center phase comprise a supply current transformer 80*a* identical to the transformers 80, with a magnetic circuit 82*a* and a secondary winding 84*a*.

The presence of at least one supply current transformer 80, 80*a* of the electronic circuit per phase is rendered necessary to ensure operation of the circuit breaker electronics in all configurations of use, and in particular when only one of the three phases is supplied.

Moreover, each of the pole compartments is provided with a measuring toroid 88 called a Rogowsky coil surrounding the contact strip, delivering a low-power signal proportional to the current flowing through the contact strip.

Figure 6:
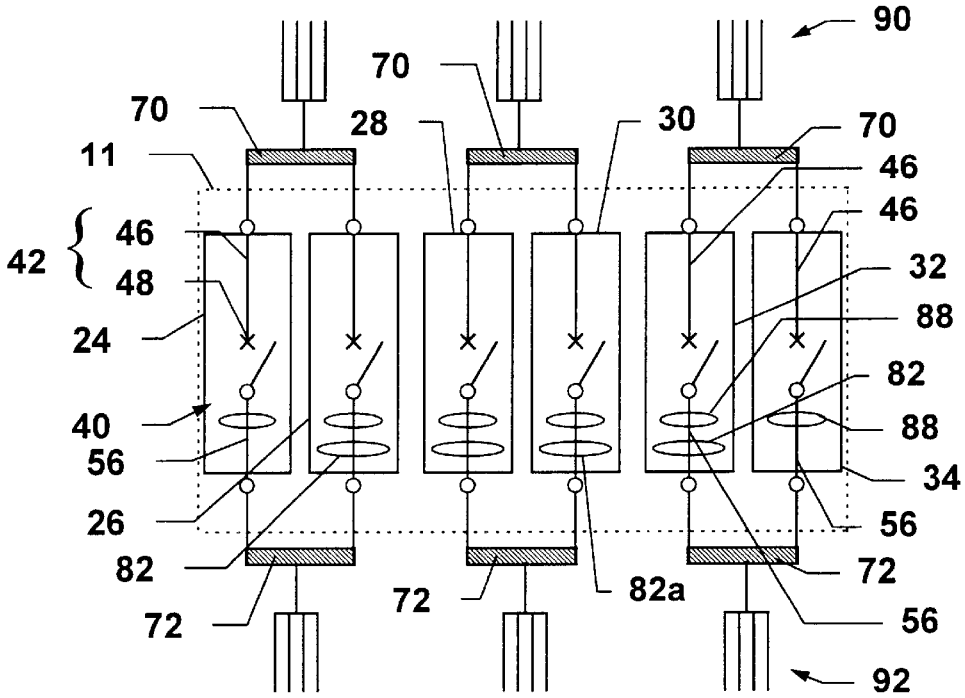
FIG. 6 represents a wiring diagram of a three-phase circuit of the electrical switchgear apparatus of FIG. 1.

FIG. 6 schematically represents the electrical circuit formed by the three phases of the circuit breaker connected to a source-side busbar 90 and a load-side busbar 92. For each phase, the bridge connections 70, 72 are connected between the source-side busbar and the load-side busbar of the phase.

Figure 7:
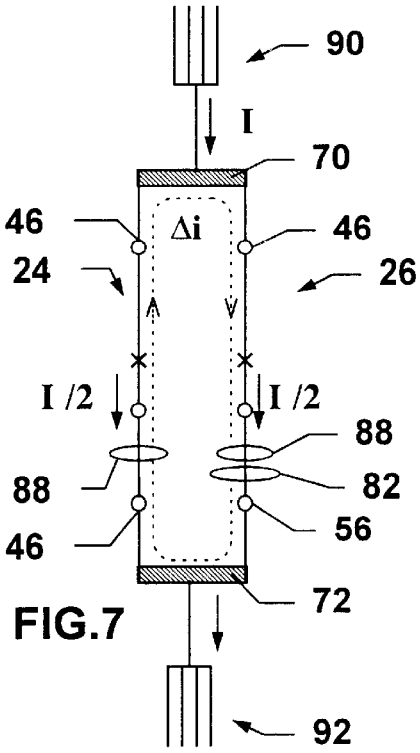
FIG. 7 represents a current flowing in a side phase of the apparatus of FIG. 1.

The wiring diagram corresponding to a side phase has been represented in a more succinct manner in FIG. 7. When the current flowing in the closed loop represented in FIG. 7 is observed, the current intensities $i_1$ and $i_2$ flowing in each of the branches of the loop can be expressed as a function of the supply current I input to the loop, in the following manner:

$$\begin{cases} i_1 = I/2 + \Delta I \\ i_2 = I/2 - \Delta I \end{cases}$$

with $(i_1+i_2)=I$ and $\Delta I=\frac{1}{2}(i_1-i_2)$ $\Delta I$ then represents a loop current, whose value is zero when the currents are balanced.

In the center phase, the two branches of the current loop are identical due to the presence of a current transformer 80*a* in each branch, and are subjected to relatively balanced electromagnetic influences generated by the side phases. Consequently, the current is divided in relatively balanced manner between the two branches of the center phase.

In each of the side phases, the circuit branch comprising the inner pole compartment (26, respectively 32) is equipped with a magnetic circuit 82 formed by the supply current transformer 80, which does not have an equivalent in the branch comprising the outer compartment (24, respectively 34). An unbalanced current distribution between the two branches would therefore be expected due to the impedance introduced in the inner branch by the magnetic circuit 82. However this is not the case: the impedance of the current transformer 80 in fact only compensates the unbalance due to the electromotive forces induced by the other phases on each of the branches of the phase in question.

This is confirmed by the test reproduced in table n°1 with the circuit breaker of the invention. A three-phase current with an rms value of 6300 A per phase was flowing through the closed circuit breaker and, after stabilization after 8 hours of operation, the rms current flowing through each pole and the temperature of the stationary contact strip were measured:

TABLE 1 circuit breaker according to the invention

| left side phase | | center phase | | right side phase | |
|---|---|---|---|---|---|
| | | | | inner | outer |
| outer pole | inner pole | left pole | right pole | pole | pole |
| t° = 79° C. | t° = 86° C. | t° = 90° C. | t° = 87° C. | t° = 83° C. | t° = 80° C. |
| $i_1$ = 3600A | $i_2$ = 3000A | $i_1$ = 3200A | $i_2$ = 3300A | $i_1$ = 3100A | $i_2$ = 3400A |

For comparison purposes, the results obtained under the same conditions with a circuit breaker, the outer pole compartments of the side phases of which are equipped with supply current transformers identical to the transformers of the inner pole compartments, have been represented schematically. A very unbalanced distribution of the currents in the branches can then be observed:

TABLE 2 circuit breaker with one transformer per pole

| left side phase | | center phase | | right side phase | |
|---|---|---|---|---|---|
| | | | | inner | outer |
| outer pole | inner pole | left pole | right pole | pole | pole |
| t° = 76° C. | t° = 97° C. | t° = 100° C. | t° = 97° C. | t° = 110° C. | t° = 76° C. |
| $i_1$ = 2500A | $i_2$ = 4000A | $i_1$ = 3750A | $i_2$ = 3500A | $i_1$ = 4050A | $i_2$ = 2300A |

This unbalance is due to the interactions between phases which is expressed at the level of each branch of the current circuit by an inductance of different value. The current flowing through the inner pole is always higher than the current flowing through the corresponding outer pole.

The comparison shows that removing the supply current transformers from the outer branches of the side phases fosters rebalancing of the currents of the branches. Moreover, a slight over-compensation even occurs, as the current flowing through the outer poles is greater than the current flowing through the inner poles of the side phases. This is advantageous, for the outer pole is able to diffuse heat better to the environment.

It therefore happens that in practice the impedance of a supply current transformer 80*a* such as is usually used with this type of pole corresponds appreciably to the impedance of the magnetic circuit 82 which has to be inserted to rebalance the circuit. The supply current transformers of the side phases then also have a function of acting as compensating magnetic circuit. For ease of industrialization, the transformers 80 are ideally identical to the center phase transformers 80*a*, which do not have the function of rebalancing. But it is also possible to provide specific transformers 80 differing from the transformers 80*a* by their size or composition.

In order for rebalancing between the currents of the pole branches to result in rebalancing of the internal temperatures of the conductors in the pole compartments, it is important that the current transformer 80 serving the purposes of compensation does not, due to its presence, generate a temperature rise of the corresponding pole compartment. This is why a magnetic circuit with stacked transformer plates is preferably used, enabling the Foucault currents in the magnetic circuit to be minimized.

The structure of the magnetic circuit 82 with a shunt with an air-gap 87 provides the advantage of enabling the core 85 and shunt 86 to be dimensioned separately for their own function. The air-gap 87 of the shunt 86 in fact gives rise to a non-linear behavior of the transformer: at low primary current level, only a very small portion of the magnetic flux can flow via the shunt 86 and pass through the air-gap 87—almost all of the flux then flows via the magnetic core 85. When the primary current I increases, the proportion of the magnetic flux able to flow via the shunt 87 increases and the proportion of flux passing via the core 85 decreases. The magnetic flux passing through the air-gap increases very rapidly when the magnetic induction produced by the primary current flowing in the conductor exceeds a certain threshold, which is determined by the size and shape of the air-gap. This enables the rms value of the secondary current and the power dissipated in the secondary circuit to be limited while at the same time dimensioning the magnetic mass of the shunt 86 according to the compensating inductance which is required to be created in the inner pole. The shunt can in particular be dimensioned so as to obtain saturation of the magnetic circuit or not, according to what is required, for the rated current of the circuit breaker. The shunt air-gap can be total or partial. In the latter case, an additional parameter is available for optimization of the non-linear behavior of the shunt, i.e. the cross-section of the part of the shunt having a zero air-gap.

According to an alternative embodiment, the compensating current transformer 80 can be located on the rear side of the rear panel of the case, outside the pole compartment, the essential point being that it is inside the current loop defined by the two bridge connections, on the inner branch of the side phases. This arrangement prevents the presence of the current transformer from causing overheating of the pole. Specific construction arrangements limiting overheating of the transformer itself can then be dispensed with.

According to another alternative embodiment for a fixed circuit breaker, each pole is provided with a supply current transformer. A specific magnetic compensation circuit is then added on the inner branches of the current loops of the side phases. In this case, on account of both dimensional requirements and thermal stress considerations, it is advantageous to arrange the two magnetic circuits on the rear face of the rear panel of the circuit breaker case.

Figure 8:
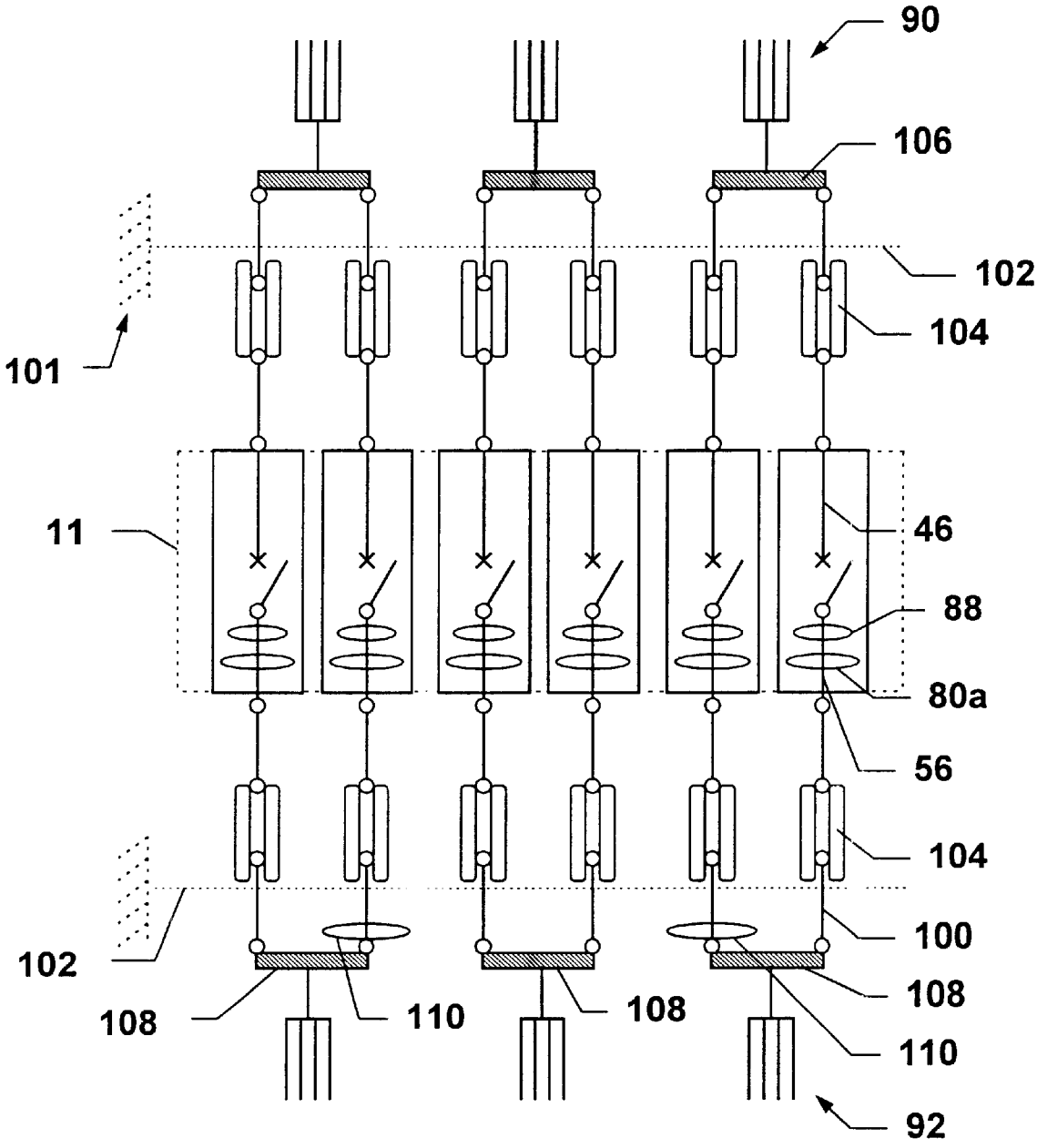
FIG. 8 represents a wiring diagram of a three-phase circuit of an electrical switchgear apparatus according to a second embodiment of the invention.

FIG. 8 represents a wiring diagram of an electrical switchgear apparatus according to a second embodiment of the invention. The reference signs used are identical to those of the first embodiment for those parts which are identical. The switchgear apparatus comprises a frame in which a circuit breaker case is able to slide between a plugged-in position and a plugged-out position. The circuit breaker is composed of pole compartments similar to those illustrated in the first embodiment of the invention. The contact strips 46, 56 of each pole are connected to connection strips 100 supported by a plate 102 forming the base-plate of the frame by means of plug-in finger contacts 104. A single plug-in finger contact has been represented per contact strip, but a plurality of plug-in finger contacts per contact strip can also be provided, as described for example in the document EP 0,926,793. The unfolded flat representation of the wiring diagram of FIG. 8 requires the plate 102 forming the frame base-plate to be made to appear twice, on the source side and on the load side, but it is clear that in reality the actual arrangement is three-dimensional and there is one base-plate 102 only. The connection strips 100 are connected two by two by means of bridge connections 106, 108 whose function is identical to that of the bridge connections 70, 72 of the first embodiment. Current loops are thus formed which comprise, for each phase, the bridge connections 106, 108, the connection strips 100, the plug-in finger contacts 104 and the contact means of the twinned poles.

Unlike the first embodiment of the invention, all the pole compartments of the circuit breaker are equipped with a supply current transformer 80*a*. A magnetic compensation circuit 110 is in addition arranged in the inner branch of each side phase. This magnetic circuit 110 has an inductance enabling the unbalance due to interaction between phases to be compensated.

This alternative embodiment presents the advantage of enabling balancing on a loop of larger size, including the plug-in finger contacts 104 and at least partially the connection strips 100. It also enables the magnetic balancing circuit 110 to be located outside the case of the circuit breaker 10, at a place where it has a slight influence only on the internal temperature of the pole compartments. It does on the other hand require additional magnetic circuits in comparison with the first embodiment. Furthermore, it does not enable complete manufacturing to be performed in-plant. The magnetic compensation circuits can be located either outside the frame, as indicated in FIG. 7, or inside, on the face of the plate 102 facing the circuit breaker 10, or even between the contact strips and the draw-in finger contacts.

A variety of variations can be envisaged. In particular, the case made of insulating material can be made up of two parts each corresponding to a case of a three-phase circuit breaker with one pole per phase, these two parts being assembled to one another as described in the document EP 0,320,412.

The invention applies equally well to a three-phase switchgear apparatus with neutral and to a three-phase switchgear apparatus without neutral. The neutral can comprise one or two pole compartments situated next to one of the side phases. Its influence on the distribution of the currents in steady-state operation is small and does not require any particular compensation.

The switchgear apparatus can be a circuit breaker, a switch with or without a disconnection function and, in a general manner, any switchgear apparatus with a very high current rating.

The measuring toroids and the magnetic supply and/or compensation circuits can be placed either on the same side as the movable contact means or on the same side as the stationary contact means. The essential thing is that the magnetic circuits performing compensation be located inside the current loop bounded by the bridge connections, on the inner branch of the side phases. Likewise, the measuring toroids and magnetic supply and/or compensation circuits can be placed indifferently either on the source side or on the load side.

By means of the invention it is possible to dimension the magnetic compensation circuits to obtain balancing of the currents $i_1$ and $i_2$ for an rms value of the current I corresponding to the rated current (in the sense of IEC standard 947-2), i.e. to the circuit breaker rating. It is also possible to provide partial compensation, in particular if the essential objective is to make the temperatures inside the pole compartments homogeneous. It has in fact been pointed out that the magnetic circuit is itself a heat source which, if the circuit is inside the compartment or around the contact strip, has an influence on the temperature inside the compartment by thermal conduction and/or thermal radiation. Finally, if the magnetic circuit dissipates little heat or if it is located outside the pole compartments, it is also possible on the contrary to provide over-compensation by dimensioning the magnetic circuit in such a way that the rms value of the current intensity in the inner pole is lower than the rms value of the current intensity in the outer pole. Indeed, cooling of the outer pole compartments of the side phases is easier due to the fact that on one face these outer compartments are not exposed to the heat of the adjacent compartment. The optimum for balancing of the temperatures can therefore correspond to a higher current in the outer pole of the side phases.

Finally, the magnetic circuit is not necessarily of the type comprising a magnetic shunt with total or partial air-gap.

What is claimed is:

1. A three-phase electrical switchgear apparatus comprising a case made of insulating material comprising at least six pole compartments arranged side by side, each phase comprising:

two adjacent poles, each pole comprising one of said pole compartments and a pair of separable contact means formed by a first and a second contact means;

a first bridge connection electrically connecting the first contact means of the two adjacent poles of said phase;

a second bridge connection electrically connecting the second contact means of the two adjacent poles of said phase;

one of the three phases constituting a center phase bounded on each side by the other two phases which each form a side phase, one of the two poles of each side phase forming an inner pole whose pole compartment is adjacent to one of the pole compartments of the center phase, wherein:

each of said inner pole compartments of the side phases comprises a magnetic compensation circuit arranged between one of the two bridge connections of said phase and the pair of contact means of said inner pole compartment, the other two pole compartments of the two side phases are not provided with magnetic compensation circuits.

2. The apparatus according to claim 1 wherein, for each inner pole compartment, the magnetic compensation circuit forms part of a current transformer comprising in addition a secondary winding for supply of an electronic circuit of the apparatus.

3. The apparatus according to claim 2 wherein, for each inner pole, the magnetic circuit comprises:

a main part surrounding a conducting part of one of the contact means, a portion of this main part constituting a core for the secondary winding; and a magnetic shunt branch-connected on said portion constituting the core of the secondary winding, the magnetic shunt comprising a total or partial air-gap.

4. The apparatus according to claim 2 wherein, for each inner pole compartment, said current transformer is situated inside said pole compartment.

5. The apparatus according to claim 2 wherein, for each inner pole compartment, said current transformer is situated outside said pole compartment.

6. The apparatus according to claim 1 wherein the magnetic compensation circuit is dimensioned in such a way that, when the apparatus is supplied in balanced three-phase operating conditions at its rated voltage and with its rated current flowing through it at its rated frequency, each magnetic compensation circuit generates an impedance in the inner pole compartment such that the current intensity flowing in the inner pole of each side phase is lower than or equal to the current intensity flowing in the other pole of the same phase.

7. The apparatus according to claim 1 wherein the bridge connections are fixedly secured to the case.

8. The apparatus according to claim 7 wherein the bridge connections are fixed outside the pole compartments.

9. The apparatus according to claim 8 wherein the apparatus is a plug-in unit and comprises:

a frame in which the case is able to slide between a plugged-in position and a plugged-out position, connection strips fixedly secured to the frame, each contact means having one of the connection strips corresponding thereto, draw-in finger contacts, each of said contact means having one or more draw-in finger contacts corresponding thereto and providing a disconnectable electrical connection between said contact means and the corresponding connection strip, said bridge connections being arranged in such a way that, for each phase, the first bridge connection electrically connects the first contact means via the draw-in finger contact or contacts corresponding to said connected first contact means and that, for each phase, the second bridge connection electrically connects the second contact means via the draw-in finger contact or contacts corresponding to said connected second contact means.

* * * * *